US009510094B2

(12) United States Patent
Paquier et al.

(10) Patent No.: US 9,510,094 B2
(45) Date of Patent: Nov. 29, 2016

(54) NOISE ESTIMATION IN A MOBILE DEVICE USING AN EXTERNAL ACOUSTIC MICROPHONE SIGNAL

(71) Applicant: Apple Inc., Cupertino, CA (US)

(72) Inventors: Baptiste P. Paquier, Saratoga, CA (US); Bryan J. James, Menlo Park, CA (US); Aram M. Lindahl, Menlo Park, CA (US)

(73) Assignee: Apple Inc., Cupertino, CA (US)

( * ) Notice: Subject to any disclaimer, the term of this patent is extended or adjusted under 35 U.S.C. 154(b) by 79 days.

(21) Appl. No.: 14/248,834

(22) Filed: Apr. 9, 2014

(65) Prior Publication Data

US 2015/0296294 A1 Oct. 15, 2015

(51) Int. Cl.
*H04R 3/00* (2006.01)
*G10L 21/0216* (2013.01)

(52) U.S. Cl.
CPC ..... *H04R 3/005* (2013.01); *G10L 21/0216* (2013.01); *G10L 2021/02165* (2013.01); *H04R 2410/05* (2013.01); *H04R 2430/03* (2013.01); *H04R 2499/11* (2013.01)

(58) Field of Classification Search
None
See application file for complete search history.

(56) References Cited

U.S. PATENT DOCUMENTS 7,706,821 B2 * 4/2010 Konchitsky ..... H04R 3/00 455/114.2
8,295,771 B2 * 10/2012 Hirsch ..... H04R 3/005 381/93
8,774,875 B1 * 7/2014 Halferty ..... H04R 3/005 379/392
2005/0281479 A1 * 12/2005 Song ..... H04N 19/139 382/275
2009/0238377 A1 * 9/2009 Ramakrishnan ..... G10L 21/028 381/92
2010/0184488 A1 7/2010 Takada
2010/0189293 A1 * 7/2010 Imamura ..... H04R 25/558 381/317
2011/0135106 A1 * 6/2011 Yehuday ..... H04R 1/1083 381/71.6
2011/0179158 A1 * 7/2011 Donnelly ..... H04L 67/18 709/224
2011/0288860 A1 11/2011 Scheveiw et al.
2012/0183154 A1 * 7/2012 Boemer ..... G10L 21/0208 381/94.1
2013/0024194 A1 1/2013 Zhao et al.
2013/0262101 A1 * 10/2013 Srinivasan ..... G10L 21/0208 704/226
2013/0272540 A1 10/2013 Ahgren et al.
2014/0355775 A1 * 12/2014 Appelbaum ..... H04R 3/002 381/71.1

* cited by examiner

*Primary Examiner* — Brenda Bernardi
(74) *Attorney, Agent, or Firm* — Blakely, Sokoloff, Taylor & Zafman LLP

(57) ABSTRACT

A mobile device uses externals microphone signals to improve the estimate of background noise that it computes. In order to improve voice quality in a first signal that is produced by an internal microphone, the mobile device identifies an external microphone device within proximity of the mobile device. The mobile device establishes a wireless connection with the external microphone device. The mobile device receives a second signal from the external microphone device through the wireless connection. The second signal is produced by a microphone of the external microphone device. The mobile device generates a noise profile based on the second signal, and then suppresses background/ambient noise from the first signal based on the noise profile. Other embodiments are also described.

19 Claims, 8 Drawing Sheets

NOISE ESTIMATION IN A MOBILE DEVICE USING AN EXTERNAL ACOUSTIC MICROPHONE SIGNAL

FIELD

An embodiment of the invention is related to digital audio signal processing techniques in mobile devices, and particularly to techniques for estimating background audible noise, which can be used to automatically reduce the audible noise that is in an audio signal containing speech, for example during a phone call or during the recording of an interview session. Other embodiments are also described.

BACKGROUND

Mobile phones enable their users to conduct conversations in many different acoustic environments. Some of these are relatively quiet while others are quite noisy. There may be high background or ambient noise, for instance, on a busy street or near an airport or train station. There are also different types of background noise, such as ocean waves, automobile drive-by noise, babble noise (e.g., in a pub), and engine noise, to name just a few. To improve the intelligibility of the near-end user's speech, to a far-end user during a call, an audio signal processing technique known as noise suppression can be implemented in the near-end user's mobile phone. During the mobile phone call, the noise suppressor operates in real-time upon a so-called uplink signal that contains not just speech of the near-end user but also background noise that has been picked up by a primary or voice dominant acoustic microphone (sometimes referred to as the bottom acoustic microphone of a smart phone handset). Before the uplink signal is transmitted by the mobile phone to the communications network (and then onward to the far-end user's device) the noise suppressor attempts to reduce the amount of the background noise that has been picked up by the bottom microphone, by performing noise removal digital signal processing operations upon the uplink signal. These operations rely on what is hopefully an accurate estimate of the background noise.

It is often difficult to discriminate between noise and speech, both of which are present in the same audio signal. The noise estimate or noise profile is often computed as a power or energy spectrum (frequency domain), and may be updated or re-computed for each frame (discrete-time sequence portion) of the uplink signal. There are various known techniques for audio noise estimation. For example, a secondary acoustic microphone may be provided in the handset and that is positioned away from the bottom microphone—this is sometimes referred to as a "top" microphone or a noise dominant microphone. It may be expected that this secondary microphone, due to its orientation and position, should pick up primarily the ambient sound, rather than the near-end user's speech. Signal processing operations are then performed upon the primary and secondary microphone signals to generate a noise profile that in many instances has proven to be more accurate than using just the bottom microphone (to discriminate between speech and noise.)

SUMMARY

A mobile device that uses external microphone signals to improve an estimate of background noise is described. In one embodiment, in order to improve the quality of user content such as voice or speech in a first signal produced using one or more internal microphones, the mobile device identifies an external microphone device as being other than a headset microphone. The external device has a microphone that produces a second signal. The mobile device establishes a wireless connection with the external microphone device. The mobile device receives the second signal from the external microphone device through the wireless connection. The mobile device generates a noise profile based on the second signal and then may use the noise profile to suppress background/ambient noise from the first signal. This can occur during a phone call or during a media recording session.

In one embodiment, the mobile device compares the second signal to an internal microphone signal in order to determine whether or not to use the second signal for generating the noise profile. The mobile device may synchronize the second signal received from the external microphone device with a signal produced by an internal microphone, before generating the noise profile and performing noise suppression operations. This may help account for the timing delay from when the external microphone produces the second signal to when the latter is received by the mobile device. In one embodiment, the mobile device receives information about the direction and range of one or more such external microphones, with regard to the user and in particular the mobile device, in order to select the "best" external microphone for generating the noise profile.

In one embodiment, the external microphone device is a wearable device that is worn on the trunk or a limb of a user of the mobile device. In another embodiment, the external microphone device is situated at a fixed, indoor location such as in a desktop computer or inside a vehicle in which the user is riding. In yet another embodiment, the external microphone device is situated at a fixed, outdoor location where the user may find himself, e.g. while walking or running In yet another embodiment, the external microphone device is integrated within another mobile device that is nearby, i.e., nearby in the sense that the external microphone device can pick up ambient or background sound that is useful for the purpose of estimating the noise in an acoustic pickup signal in the mobile device.

A method in a microphone device that can help improve a process for computing a background noise estimate in a nearby audio device is described. The microphone device identifies an external audio device within its proximity. The microphone device establishes a wireless connection with the external audio device. The microphone device sends a first signal produced by an internal microphone to the external audio device through the wireless connection to enable the external audio device to compute a background noise estimate.

In one embodiment, the microphone device transfers to the external audio device audio content data that's either uncompressed or encoded with a lossless codec like Free Lossless Audio Codec (FLAC). The audio bitrates (or formats) in that case need not be supported by the Bluetooth standard. The microphone device could send such audio content data to the external audio device over a Wi-Fi link or another wireless local area network link.

In one embodiment, the microphone device can send data other than an audio content stream, e.g., analytics, to the external audio device. For example, the microphone device may compute a noise estimate or noise profile (e.g., for just a specified frequency band, or for the entire audio spectrum) based on its internal microphone signal, and such analytics could then be sent to the external audio device (without the underlying microphone signal). The external audio device would then update its noise suppressor based on the received analytics.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The invention is illustrated by way of example and not limitation in the figures of the accompanying drawings in which like references indicate similar elements.

DETAILED DESCRIPTION

A method and apparatus of a device that uses externals microphone signals in order to improve the estimate of the background noise is described. In the following description, numerous specific details are set forth to provide thorough explanation of embodiments of the present invention. It will be apparent, however, to one skilled in the art, that embodiments of the present invention may be practiced without these specific details. In other instances, well-known components, structures, and techniques have not been shown in detail in order not to obscure the understanding of this description.

Reference in the specification to "one embodiment" or "an embodiment" means that a particular feature, structure, or characteristic described in connection with the embodiment can be included in at least one embodiment of the invention. The appearances of the phrase "in one embodiment" in various places in the specification do not necessarily all refer to the same embodiment.

In the following description and claims, the terms "coupled" and "connected," along with their derivatives, may be used. It should be understood that these terms are not intended as synonyms for each other. "Coupled" is used to indicate that two or more elements, which may or may not be in direct physical or electrical contact with each other, co-operate or interact with each other. "Connected" is used to indicate the establishment of communication between two or more elements that are coupled with each other.

The processes depicted in the figures that follow are performed by processing logic that comprises hardware (e.g., circuitry, dedicated logic, etc.), software (such as is run on a general-purpose device or a dedicated machine), or a combination of both. Although the processes are described below in terms of some sequential operations, it should be appreciated that some of the operations described may be performed in different order. Moreover, some operations may be performed in parallel rather than sequentially.

An embodiment of the invention is a noise suppression system for a mobile phone that uses external microphone signals, i.e., signals produced by microphones outside of the handset housing of the mobile phone, in order to improve the estimate of the background noise, so that the caller at the far end can receive a more intelligible voice signal. In one embodiment, an external signal is wirelessly received from microphones located on a companion wearable device other than a headset, such as a wrist band, an item worn on the belt, etc. In another embodiment, the external signal is wirelessly received from a remote microphone that is situated at a fixed location (e.g., in a home appliance, a street lamp, a wireless base station, a fixed electronic device, or in a building or anywhere outdoors) but within the proximity of the mobile phone. In yet another embodiment, the external signals are wirelessly received from microphones on other nearby mobile devices.

Figure 1:
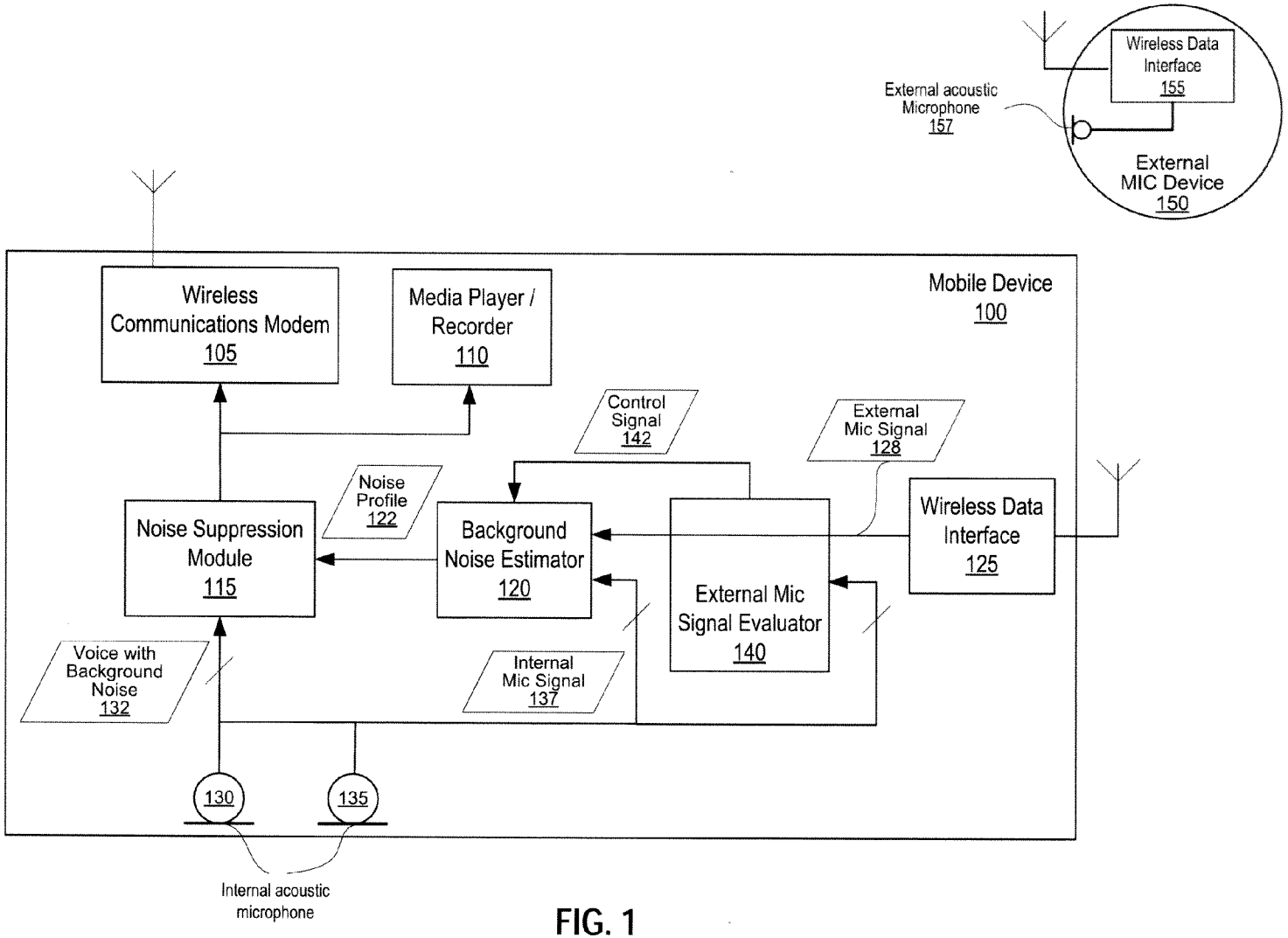
FIG. 1 illustrates a detailed diagram of a mobile device that uses signals from an external microphone device to improve the estimate of the background noise.

FIG. 1 illustrates a detailed diagram of a mobile device 100 (such as a smartphone handset) that uses one or more signals from an external microphone device 150 to improve the estimate of the background noise in accordance with one embodiment of the invention. Specifically, this figure illustrates a set of modules or components (including data processing modules) for performing background noise estimation using external microphone signals. As shown in FIG. 1, the mobile device 100 includes a wireless communications modem 105, a media player/recorder 110, a noise suppression module 115, a background noise estimator 120, an external microphone signal evaluator 140, internal acoustic microphones 130 and 135, and a wireless data interface 125.

The external microphone device 150 includes a wireless data interface 155 and an external acoustic microphone 157, which could be a single microphone or an array of microphones. The external acoustic microphone 157 produces an external audio channel that may be expected to contain primarily the background noise with little or no user speech content, i.e., the voice of the user of the mobile device 100, due to being farther away from the user's mouth. In one embodiment, the audio channel contains a time-domain audio signal produced by the external acoustic microphone 157 being a single acoustic microphone. In another embodiment, the audio channel contains an audio signal that is the result of digital signal processing performed upon a number of raw microphone signals of a microphone array, in order to achieve spatially selective pickup of sound, i.e., having a given pickup beam pattern (e.g., more sensitive to sound arriving from one direction than in another).

In one embodiment, instead of containing the audio signal produced by the external acoustic microphone 157, the external audio channel contains analytics that are relevant to audio noise estimation using the audio signal. Examples of the analytics include a limited frequency domain conversion of the raw microphone signal (e.g. previously determined frequency bins only), and a spectral noise profile (frequency domain) that was computed in accordance with any suitable audio noise estimation process. Discernible speech may be removed when generating the analytics, so that the analytics make it difficult to re-compose any original speech that may have been present in the external microphone signal.

The external microphone device 150 sends the audio channel to the mobile device 100 through the wireless data interface 155. In one embodiment, the wireless data interface 155 uses the Bluetooth protocol. In another embodiment, the wireless data interface 155 uses Wi-Fi or another wireless protocol.

The wireless data interface 125 of the mobile device receives the external audio channel produced by the external microphone device 150 and in one embodiment sends the received external microphone signal 128 to the background noise estimator 120. The background noise estimator 120 in turn generates a noise profile 122 based on the external microphone signal 128 and sends the noise profile 122 to the noise suppression module 115. In one embodiment, the wireless data interface 125 uses the Bluetooth protocol. In another embodiment, the wireless data interface 125 uses Wi-Fi or another wireless protocol.

The internal acoustic microphone 130, may be the bottom acoustic microphone of a smart phone handset, or a microphone that is within an earphone housing (also refereed to as a wireless or wired headset) that ends up being closest to the user's mouth. The microphone 130 can be a single microphone or it can be an array of microphones. In one embodiment, signal processing circuitry inside the mobile device 100 (not shown) produces an audio channel 132 that contains primarily the user's speech signal with background noise, either as a single microphone signal or an optimized pick-up signal produced by a beam forming process based on raw microphone signals of an array of microphones, e.g., using features or values extracted from the raw audio streams and resulting from heuristics or signal processing performed upon them.

The internal acoustic microphone 135 may be a top microphone of a smartphone or cellular phone handset, or a noise dominant microphone. Alternatively, the microphone 135 may be a microphone that is housed within an earphone housing (also referred to as a wired or wireless headset). The internal acoustic microphone 135 picks up the ambient sound, however because of its proximity to the bottom microphone (internal acoustic microphone 130), for example by virtue of being in the same phone housing as the bottom microphone, the top microphone (internal acoustic microphone 135) often produces an audio signal that is too similar to the one produced by the internal acoustic microphone 130. Even though it farther away from the user's mount than the bottom microphone, the top microphone can still pickup the near-end user's speech, making it difficult to use to discriminate between speech and noise (for purposes of estimating the background or ambient noise.)

In one embodiment, the mobile device 100 has an external microphone signal evaluator 140 that receives an external microphone signal 128 (within an audio channel) from the wireless data interface 125, as well as an internal microphone signal 137 from the internal acoustic microphone 130 and/or the internal acoustic microphone 135. The evaluator 140 compares the external microphone signal 128 or audio channel with the signals from the internal microphones 130, 135 to determine whether or not to use the external microphone signal 128, to generate the noise profile 122. For example, if the external microphone signal 128 is very similar to the internal microphone signal 137, the external microphone signal evaluator 140 may decide that the external microphone signal 128 does not contain a better sampling of background/ambient noise, and therefore should not be used to generate the noise profile 122. In one embodiment, the external microphone signal evaluator 140 sends a control signal 142 to the background noise estimator 120. The control signal 142 indicates whether or not to use the external microphone signal 128 for noise profile generation.

In one embodiment, the background noise estimator 120 generates the noise profile 122 using the external microphone signal 128 instead of the top microphone signal (internal microphone signal 137), when so indicated by the evaluator block 140. Otherwise, the background noise estimator 120 generates the noise profile 122 using the top microphone signal (internal microphone signal 137.) In another embodiment, if the control signal 142 indicates that the external microphone signal 128 should be used to generate the noise profile, the background noise estimator 120 generates the noise profile 122 using both the internal microphone signal 137 (bottom microphone signal) and the external microphone signal 128—this may be referred to as a two-channel noise estimation process.

In one embodiment, the external microphone signal 128 is only stored in volatile memory within the external microphone device 150 in a transient manner, i.e., only to the extent needed for performing noise analytics processing (as mentioned below) or delivery of the external mic signal to the evaluator 140 and to the noise estimator 120 in the mobile device 100. In the same vein, the external microphone signal 128 need only be stored (preferably in volatile memory) within the mobile device 100 in a transient manner, i.e., only to the extent needed to evaluate it (e.g., computing a measure of correlation for it) or otherwise process it to produce the noise profile 122.

The noise suppression module 115 receives the noise profile 122 from the background noise estimator 120, and the audio channel 132 from the internal microphone 130. The noise suppression module 115 suppresses background noise in the audio channel 132, by for example removing or subtracting the noise profile 122 from, or applying attenuation to, the audio channel 132. In one embodiment, the subtraction is performed in the frequency domain. In another embodiment, the subtraction is performed in the time domain. The attenuation may be applied on a per time frame basis, and can vary as a function of frequency bin (as per the noise profile.)

In one embodiment, the noise suppression module 115 sends the noise suppressed voice signal to the wireless communications modem 105, which then sends the filtered voice to another party of the phone call session through a wireless communications network link, e.g., a cellular telephony link or a Wi-Fi-based telephony link In another embodiment, the noise suppression module 115 sends the noise suppressed voice to a media player/recorder 110 when recording the user's voice.

The mobile device 100 was described above for one embodiment of the invention. One of ordinary skill in the art will realize that in other embodiments digital audio processing operations performed in this device can be implemented differently. For instance, in one embodiment described above, certain modules are implemented as software modules or software components that are being executed by one or more data processing elements (generically referred to here as a "programmed processor".) However, in another embodiment, some or all of the modules might be implemented for the most part in hardwired logic, which can be dedicated application specific hardware (e.g., an application specific integrated circuit, ASIC, chip, having hardwired digital filter components, dedicated volatile memory, glue logic, and state machines).

Figure 2:
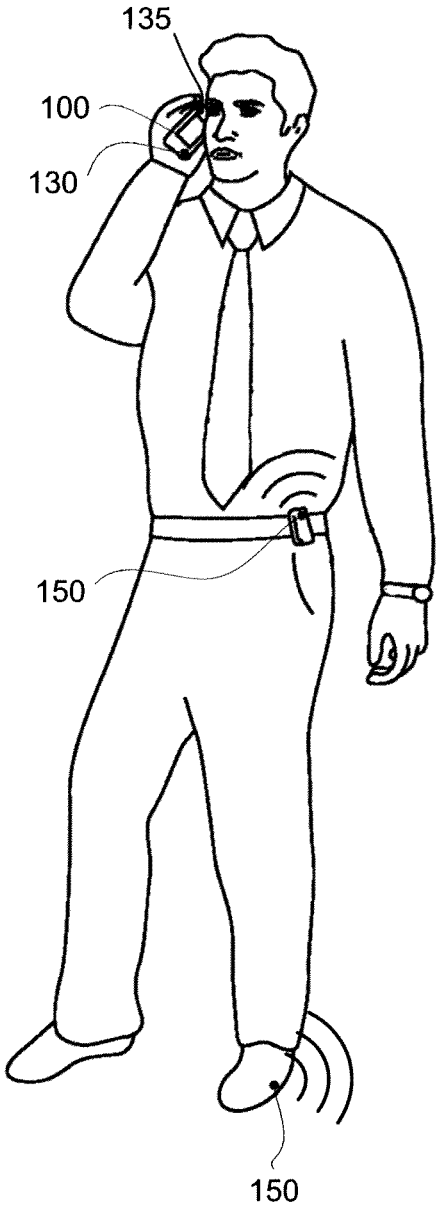
FIG. 2 illustrates an example of using external signals received from microphones located on a companion wearable device to improve the estimate of the background noise.

FIG. 2 illustrates an example of using external signals received from microphones located on a companion wearable device, to improve the estimate of the background noise for a mobile device 100. Specifically, this figure shows a user making a phone call using his mobile device 100 being in this case a smartphone. In one embodiment, the internal microphones 130, 135 described above may be integrated in the housing of a smartphone handset as shown, namely as the bottom and top microphones, respectively. In another embodiment (not shown), the microphone 130 can be integrated into the housing of a headset or earphone/headphone. The latter may be communicatively connected to an audio source device such as a smartphone handset or a tablet computer or a laptop computer, via a wired connection or via a wireless, e.g., Bluetooth, connection.

There can be one or more external microphones located on wearable devices worn by the user. As illustrated in FIG. 2, the external microphone device 150 described in FIG. 1 above is, for example, a belt worn device, a wrist worn device, a leg worn device, or a shoe worn device. While FIG. 1 shows a single external microphone device 150 communicating with the mobile device 100, there may be several instances of such an external microphone device 150 that are simultaneously present near the mobile device 100 and the user. In one embodiment, the evaluator 140 evaluates one or more of the audio channels produced by several nearby external microphone devices 150, and may select one of them for use by the noise estimator.

At least one of the external microphone devices can act as a reference microphone for the mobile device 100 and produce a background noise audio channel that picks up mostly background/ambient noise of the environment in which the user is located. In one embodiment, the mobile device 100 can perform the evaluation block (external microphone signal evaluator 140 in FIG. 1 above) to select at least one of the external microphone devices from which to obtain a signal that will be deemed to be the reference microphone signal.

In one embodiment, the external microphone signal is only stored in preferably volatile memory within the external microphone device 150 in a transient manner, i.e., only to the extent needed for performing noise analytics processing (as mentioned below) or delivery of the signal to the evaluator 140 and noise estimator 120 in the mobile device 100. In the same vein, the external microphone signal need only be stored (preferably in volatile memory) within the mobile device 100 in a transient manner, i.e., only to the extent needed to evaluate it (e.g., computing a measure of correlation for it) or otherwise process it to produce the noise profile.

In one embodiment, the mobile device 100 receives information about the direction and range of one or more external microphones, with respect to the location of the user and in particular the mobile device 100, in order to select the "best" external microphone for noise estimation. In one embodiment, the reference microphone is selected based on certain heuristics, e.g., by comparing strengths of frequency components of the signals produced by the external microphone devices. In one embodiment, a process running in the mobile device 100 changes in real-time which microphone it designates as the reference microphone, during a voice communication session or during a recording session. For instance, the evaluator may change the reference microphone designation when a separation or strength difference between a signal from one of the external devices and the speaker voice signal (produced by the internal microphone 130) is greater than the strength difference computed for the current reference microphone. The newly designated reference microphone sends its signal which contains the background noise audio channel to the mobile device 100, which in turn uses the background noise audio channel to improve the estimate of the background/ambient noise, thus improving quality of the uplink audio sent to the cellular communication network.

The external microphone devices can help the mobile device 100 to improve the estimate of the background noise because the external microphone devices are located far away from the user's mouth but within the proximity of the user, so that they pick up little or no audio signal related to the user's voice communication and yield a better estimate of the background/ambient noise. In one embodiment, the external microphones are only worn at the trunk or limb parts of the user's body so that they are far enough from the user's mouth to produce a better estimate of background/ambient noise.

Figure 3:
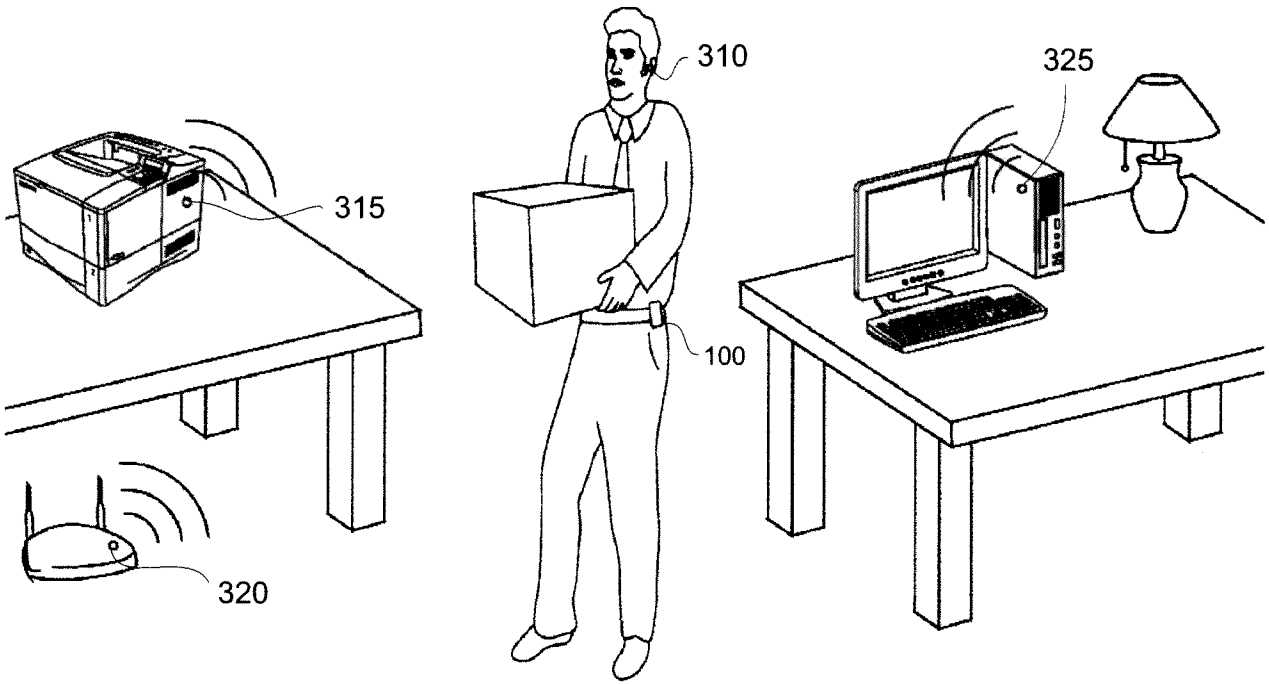
FIG. 3 illustrates an example of using external signals received from remote microphones situated at fixed indoor locations.

FIG. 3 illustrates an example of using external signals received from remote microphones situated at fixed indoor locations, to improve the estimate of the background noise. Specifically, this figure shows a user making a phone call using his mobile device 100 through a headset 310 worn on his ear (hands-free mode) in an indoor environment. In one embodiment, instead of being a smartphone, the device 100 can be a different type of mobile device, e.g., a tablet computer.

One or more internal microphones (not shown) on the headset 310 produce a primary or talker audio channel that reflects pick up of the user's voice, as well as ambient/background noise of the environment in which the user is located. In one embodiment, the mobile device 100 is the mobile device 100, and the internal microphones of the headset are internal microphones 130, 135 described in FIG. 1 above. The audio signal paths from each of the internal microphones of the headset 310 to the noise suppression module 115, the back ground noise estimator 120, and the external mic signal evaluator 140 (see FIG. 1) may be implemented through wired or wireless links, e.g., through a 4-conductor wired headset cable, or through a Bluetooth link.

There can be one or more external microphones situated on fixed indoor locations. For example and as illustrated in FIG. 3, there is a microphone device 315 located on a printer, a microphone device 320 located on a router or wireless base station or wireless access point, and a microphone device 325 located on a desktop computer. In one embodiment, an external microphone is situated inside a vehicle, such as an automobile, a motorcycle, or an airplane, in which the user is riding. In one embodiment, each of the microphone devices 315-325 is the external microphone device 150 described in FIG. 1 above.

One of the microphone devices 315-325 can act as or be designated as a reference microphone for the mobile device 100, such as one that is used in an acoustic noise cancellation (ANC) process. The reference microphone is considered one that is more likely to produce a background noise audio channel by being aimed or positioned for picking up mostly background/ambient noise of the environment in which the user is located. In one embodiment, the mobile device 100 can perform the evaluation process (external microphone signal evaluator 140 in FIG. 1 above) to select at least one of the microphone devices 315-325 to be the reference microphone or reference microphone channel.

In one embodiment, the external microphone signal is only stored in preferably volatile memory within the external microphone device in a transient manner, i.e., only to the extent needed for performing noise analytics processing (as mentioned below) or delivery of the signal to the evaluator 140 and noise estimator 120 in the mobile device 100. In the same vein, the external microphone signal need only be stored (preferably in volatile memory) within the mobile device 100 in a transient manner, i.e., only to the extent needed to evaluate it (e.g., computing a measure of correlation for it) or otherwise process it to produce the noise profile.

In one embodiment, the mobile device 100 receives information about the direction and range of one or more external microphones, with regard to the position of the user and in particular that of the mobile device 100, in order to select the "best" external microphone for noise estimation.

In one embodiment, the reference microphone is selected by the evaluator block 140, based on certain heuristics, e.g., by comparing amplitude of the signals produced by two or more external microphone devices. In one embodiment, the mobile device 100 changes its designation of the reference microphone during a voice communication session or during a recording session, e.g., when detecting an unusually big difference between the reference microphone signal and the speaker voice signal (the latter being produced by the internal microphone 130.)

The external microphone devices 315-325 may perform better than the microphone on the headset 310 in helping the mobile device 100 improve its estimate of the background noise. This is because microphone devices 315-325 are located far away from the user's mouth but within the proximity of the user, so that they pick up less of the user's voice than any microphone in the headset 310, and therefore yield a better estimate of the background/ambient noise.

In one embodiment, audio streams are gathered from several external microphone devices at a specific location and are broadcasted to mobile devices located within the proximity of the specific location, should the mobile devices want to use these audio streams to improve their estimate of background/ambient noise.

Figure 4:
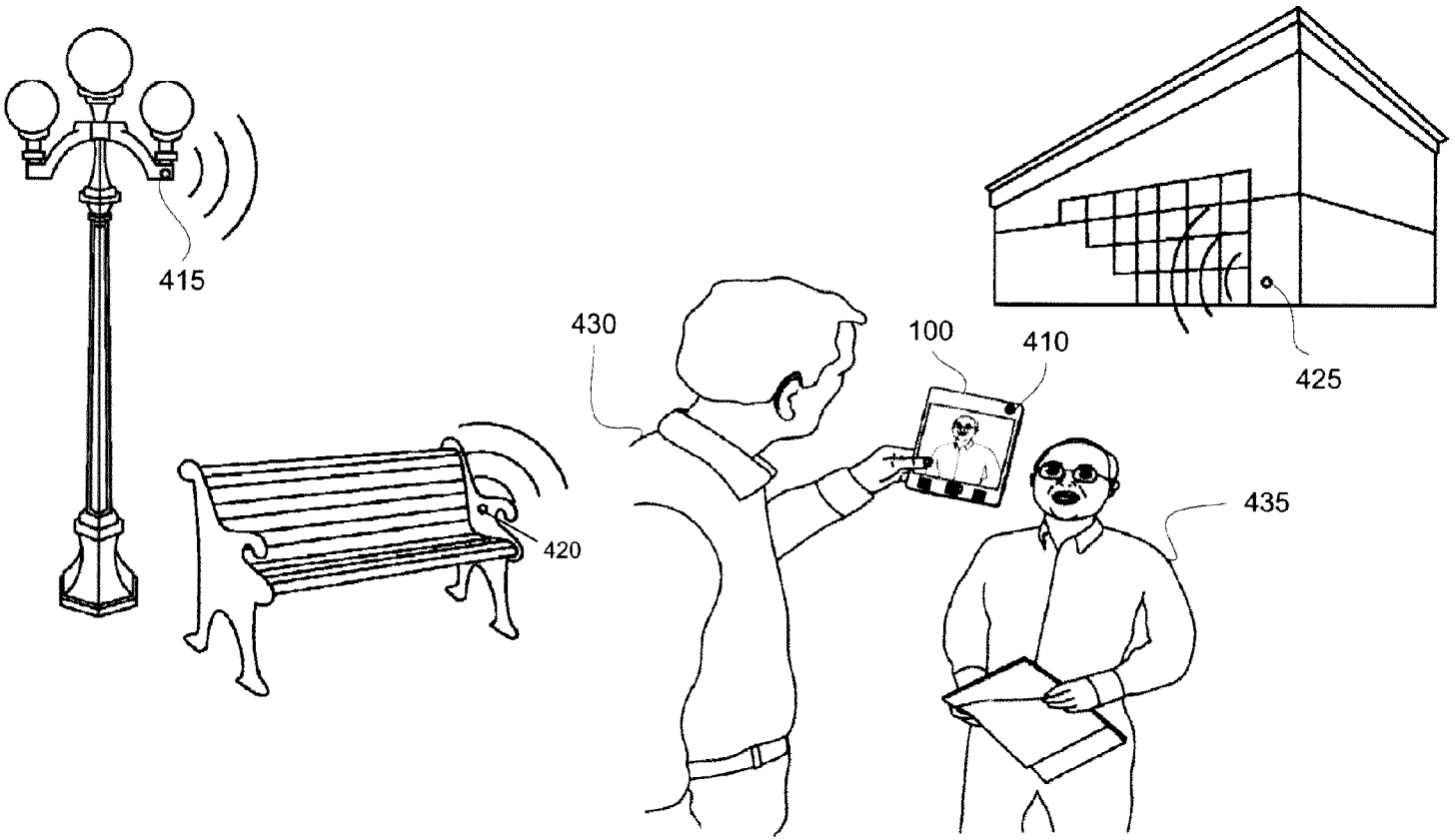
FIG. 4 illustrates an example of using external signals received from remote microphones situated at fixed outdoor locations.

FIG. 4 illustrates an example of using external signals received from remote microphone devices 415, 420, 425 that are situated on fixed outdoor locations, to improve the estimate of the background noise in accordance with one embodiment of the present invention. This figure also shows a user 430 holding his mobile device 100 up and away from himself to record the audio/video of another user 435 in an outdoor environment. In one embodiment, instead of being a smartphone, the device 100 can be a different type of mobile device, e.g., a tablet computer as shown. There is an internal microphone 410 on the mobile device 100. The internal microphone 410 produces an audio channel that picks up voice of the user 435, as well as ambient/background noise from the environment in which the user 435 is located. In one embodiment, the internal microphone 410 may be part of the mobile device 100 as described in FIG. 1, and the remote microphone devices 415, 420, 425 may be instances of the external mic device 150 also described in FIG. 1 above.

There can be one or more external microphones situated on fixed outdoor locations. For example and as illustrated in FIG. 4, there is a microphone device 415 located on a street lamp, a microphone device 420 located on a park chair, a microphone device 425 located on a building (e.g., a train station, a landmark architecture building, an airport, a bus station). In one embodiment, each of the microphone devices 415-425 is the external microphone device 150 described in FIG. 1 above.

One of the microphone devices 415-425 can act as a reference microphone for the smartphone 100 and produce a background noise audio channel that picks up mostly background/ambient noise of the outdoor environment in which the user is located. In one embodiment, the mobile device 100 can perform the evaluation block (external microphone signal evaluator 140 in FIG. 1 above) to select at least one of the microphone devices 415-425 as a reference microphone.

In one embodiment, the external microphone signal is only stored in preferably volatile memory within the external microphone device in a transient manner, i.e., only to the extent needed for performing noise analytics processing (as mentioned below) or delivery of the signal to the evaluator 140 and noise estimator 120 in the mobile device 100. In the same vein, the external microphone signal need only be stored (preferably in volatile memory) within the mobile device 100 in a transient manner, i.e., only to the extent needed to evaluate it (e.g., computing a measure of correlation for it) or otherwise process it to produce the noise profile.

In one embodiment, the mobile device 100 receives information about the direction and range of one or more external microphones, with regard to the user and in particular the mobile device 100, in order to select the "best" external microphone for noise estimation. In one embodiment, the reference microphone is selected based on certain heuristics, e.g., by comparing amplitude of the signals produced by the external microphone devices in the frequency domain. In one embodiment, the mobile device 100 changes reference microphone during a voice communication session, e.g., when detecting an unusually big difference between the reference microphone signal and the speaker voice signal produced by the internal microphone 130. The reference microphones then send signals of the background noise audio channel to the mobile device 100, which in turn uses the background noise audio channel to improve the estimate of the background/ambient noise, thus improving quality of the uplink audio sent to the cellular communication network. In one embodiment, a reference microphone sends signals of the background noise audio channel to the mobile device 100 wirelessly.

The external microphone devices 415-425 can help the mobile device 100 to improve the estimate of the background noise because the external microphone devices 415-425 are located far away from the mouth of user 435 but within the proximity of the user 435, so that they pick up little or no audio signal related to voice communication of the user 435 and yield a better estimate of the background/ambient noise. In one embodiment, the proximity of the mobile device 100 to the external microphone devices 415-425 is determined by their respective Global Positioning System (GPS) locations. In one embodiment, audio streams are gathered from external microphone devices at a specific location and are broadcasted to mobile devices located within the proximity of the specific location, should the mobile devices want to use these audio streams to improve the estimate of background/ambient noise.

Figure 5:
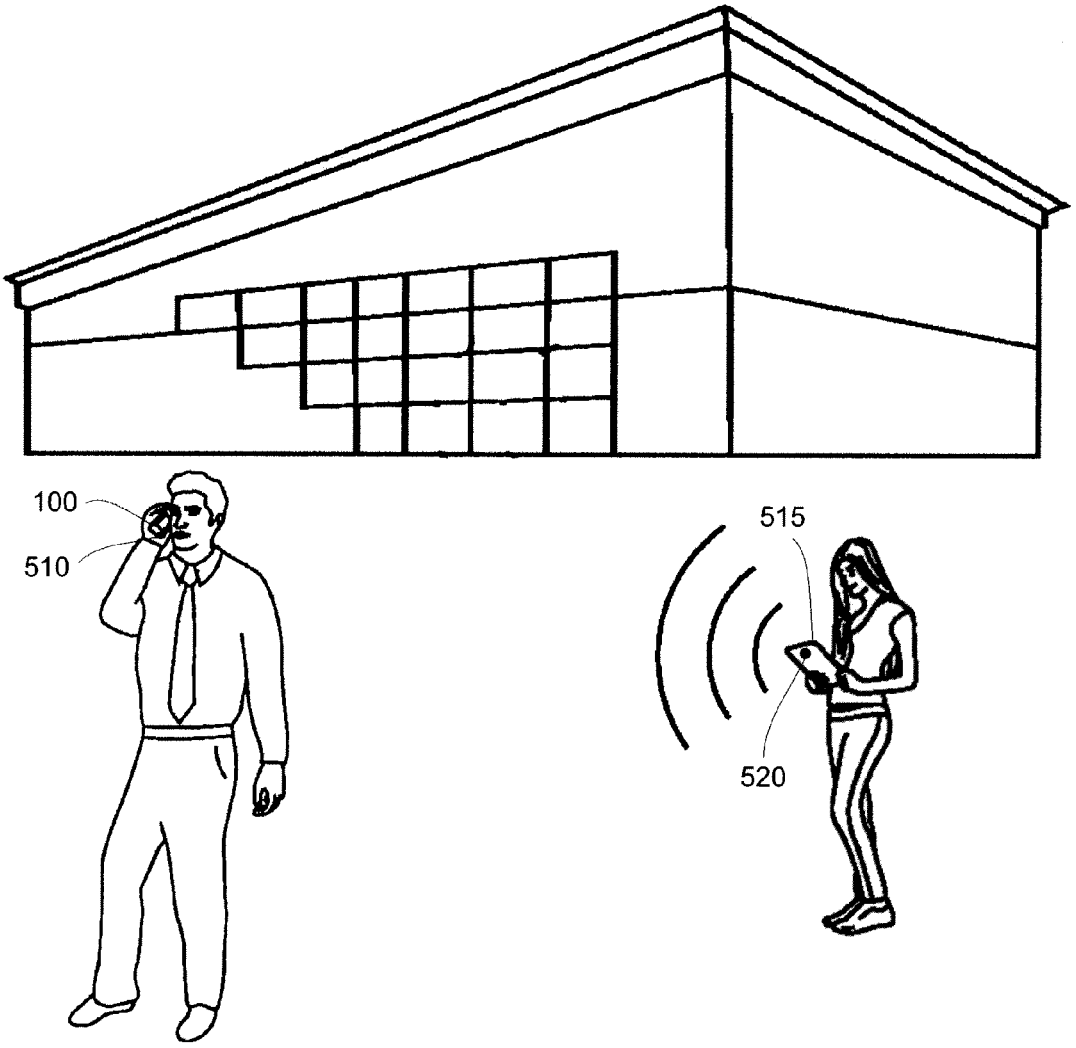
FIG. 5 illustrates an example of using external signals received from remote microphones on other users' devices.

FIG. 5 illustrates an example of using external microphone signals received from remote microphones that are in other users' mobile devices. Specifically, this figure shows a user making a phone call using his mobile device 100 while another user is using her tablet computer 515 nearby. In one embodiment, instead of being a smartphone, the device 100 can be a different type of mobile device, e.g., a tablet computer. Similarly, in one embodiment, instead of being a tablet computer, the device 515 can be a different type of mobile device, e.g., a smartphone.

There is an internal microphone 510 on the mobile device 100. The internal microphone 510 produces an audio channel that picks up the near by user's voice, as well as ambient/background noise from the environment in which the user is located. In one embodiment, the mobile device 100 and the internal microphone 510 are the mobile device 100 and the internal microphone 130 described in FIG. 1 above, respectively.

There can be one or more external microphones situated on other users' devices within the proximity of the mobile device 100. For example and as illustrated in FIG. 5, there is a microphone device 520 located on a tablet computer 515 of another user nearby. In one embodiment, the microphone device 520 is the external microphone device 150 described in FIG. 1 above.

The microphone device 520 can act as a reference microphone for the mobile device 100 and produce a background noise audio channel that picks up mostly background/ambient noise of the environment in which the users are located. The reference microphones then send their picked-up background noise audio channel to the mobile device 100, which in turn uses the background noise audio channel to improve its estimate of the background/ambient noise, thus improving quality of the uplink audio sent to a wireless telephony communication network. In one embodiment, the microphone device 520 sends signals of the background noise audio channel to the mobile device 100 wirelessly.

In one embodiment, the external microphone signal is only stored in preferably volatile memory within the external microphone device (here, tablet computer 515) in a transient manner, i.e., only to the extent needed for performing noise analytics processing (as mentioned below) or delivery of the signal to the evaluator 140 and noise estimator 120 in the mobile device 100. In the same vein, the external microphone signal need only be stored (preferably in volatile memory) within the mobile device 100 in a transient manner, i.e., only to the extent needed to evaluate it (e.g., computing a measure of correlation for it) or otherwise process it to produce the noise profile.

The external microphone device 520 can help the mobile device 100 to improve the estimate of the background noise because the external microphone device 520 is located far away from the user's mouth but within the proximity of the user, so that the external microphone device 520 can pick up little or no audio signal related to the voice of the user of the mobile device 100 and yield a better estimate of the background/ambient noise. In one embodiment, the proximity of the mobile device 100 and the external microphone device 520 are determined by their respective Global Positioning System (GPS) locations. In another embodiment, the proximity of the mobile device 100 to the external microphone device 520 is determined by another location identification technique, such as cellular network-based position tracking In one embodiment, audio streams are gathered from external microphone devices at a specific location and are broadcasted to mobile devices located within the proximity of the specific location, should the mobile devices want to use these audio streams to improve the estimate of background/ambient noise.

Even though different types of external microphone devices are described separately in FIGS. 2-5 above, one of ordinary skill in the art will realize that in other embodiments these different types of external microphone devices can co-exist. For example, the wearable external microphone devices can co-exist with external microphone devices fixed at indoor/outdoor locations. In that case, the mobile device can perform the evaluation block (external microphone signal evaluator 140 in FIG. 1 above) to select at least one of the several external microphone devices as a reference microphone. In one embodiment, the mobile device receives information about the direction and range of one or more external microphones, with regard to the user and in particular the mobile device, in order to select the "best" external microphone for noise estimation.

Figure 6:
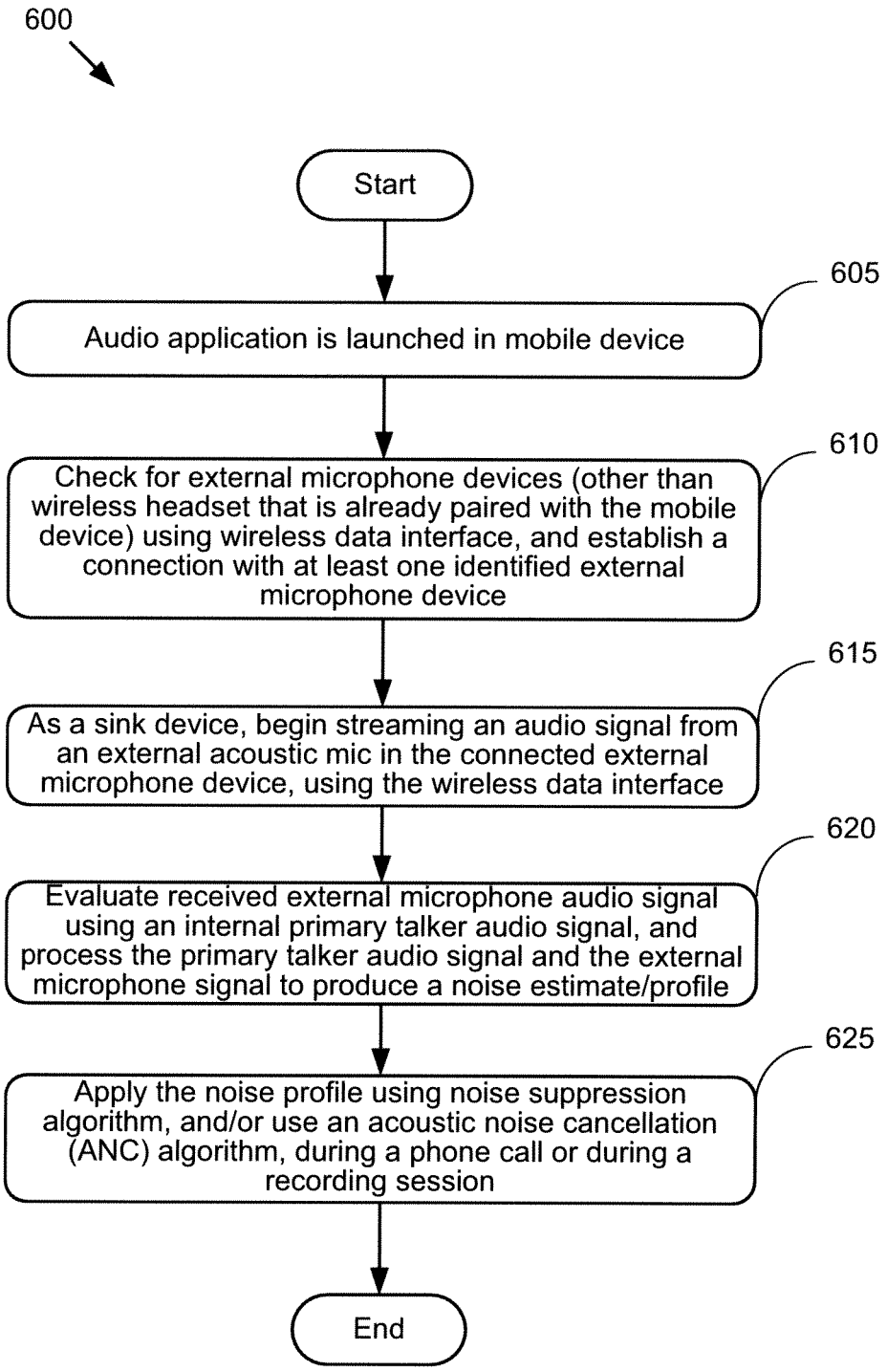
FIG. 6 illustrates a flowchart of one embodiment of operations in the mobile device.

FIG. 6 illustrates a flowchart operations performed in a mobile device, referred to as process 600. In one embodiment, the mobile device (e.g., the device of FIG. 1) executes process 600 when a phone call is initiated or a media recording session is started or other audio application is launched. As illustrated in FIG. 6, process 600 begins by launching (at block 605) an audio application in the mobile device. For example and in one embodiment, the audio application is a phone application on the mobile device that can be used to make phone calls. In one embodiment, the audio application is a video and/or audio recording application.

At block 610, process 600 checks for external microphone devices (other than a wireless headset that may already be paired with the mobile device) using the wireless data interface of the mobile device, and establishes a connection with at least one detected external microphone device. In one embodiment, each of the external microphone devices detected is an external microphone device 150 described in FIG. 1 above. In one embodiment, several external microphone devices can be detected, and these may be a mixture of one of more types of external microphone devices described in FIGS. 2-5 above. In one embodiment, process 600 picks one of the detected external microphone devices according to certain heuristics, e.g., by comparing amplitude of the signals produced by the external microphone devices in the frequency domain, and then establishes a connection with the picked external microphone device. In one embodiment, the wireless data interface of the mobile device is the wireless data interface 125 described in FIG. 1 above. In one embodiment, the wireless data interface of the mobile device selects a predefined Bluetooth profile in order to detect the external microphone devices and establish connections therewith. In one embodiment, the wireless data interface of the mobile device uses generic audio/video distribution profile (GAVDP) to detect and establish connections with the external microphone devices.

At block 615, process 600 begins streaming an audio signal from an external acoustic microphone in the connected external microphones device (source device) to the mobile device (sink device) using the wireless data interface. In one embodiment, the wireless data interface of the mobile device uses GAVDP to stream audio from the connected external microphones device to the mobile device.

At block 620, process 600 evaluates the received external microphone audio signal using for example an internal primary talker audio signal or another internal microphone signal (such as a secondary microphone signal or the top microphone signal), and processes those signals to produce a noise estimate/profile of the background/ambient noise. In one embodiment, process 600 performs a cross correlation operation between different audio signals, to synchronize for example the internal primary talker audio signal and the external microphone signal. In one embodiment, process 600 uses time stamps associated with each of the audio signals, to synchronize them. At block 625, process 600 applies the noise profile using a noise suppression algorithm to the primary talker audio signal, and/or uses an acoustic noise cancellation (ANC) algorithm, during a phone call or during a media recording session. The ANC algorithm creates an anti-noise signal (based on an external reference microphone signal), which can then be combined with the downlink signal or a media playback signal that the near-end user is hearing, to reduce the ambient acoustic noise that would otherwise be heard by the near-end user.

In one embodiment, the external microphone signal is only stored in preferably volatile memory within the external microphone device in a transient manner, i.e., only to the extent needed for performing noise analytics processing (as mentioned below) or delivery of the signal to the evaluator 140 and noise estimator 120 in the mobile device 100. In the same vein, the external microphone signal need only be stored (preferably in volatile memory) within the mobile device 100 in a transient manner, i.e., only to the extent needed to evaluate it (e.g., computing a measure of correlation for it) or otherwise process it to produce the noise profile or other analytics that will be sent to the evaluator 140 or estimator 120 in the mobile device 100.

One of ordinary skill in the art will recognize that process 600 is a conceptual representation of the operations executed by the mobile device to use external microphone signals to improve noise estimation. The specific operations of process 600 may not be performed in the exact order shown and described. The specific operations may not be performed in one continuous series of operations, and different specific operations may be performed in different embodiments. Furthermore, process 600 could be implemented using several sub-processes, or as part of a larger macro process.

Figure 7:
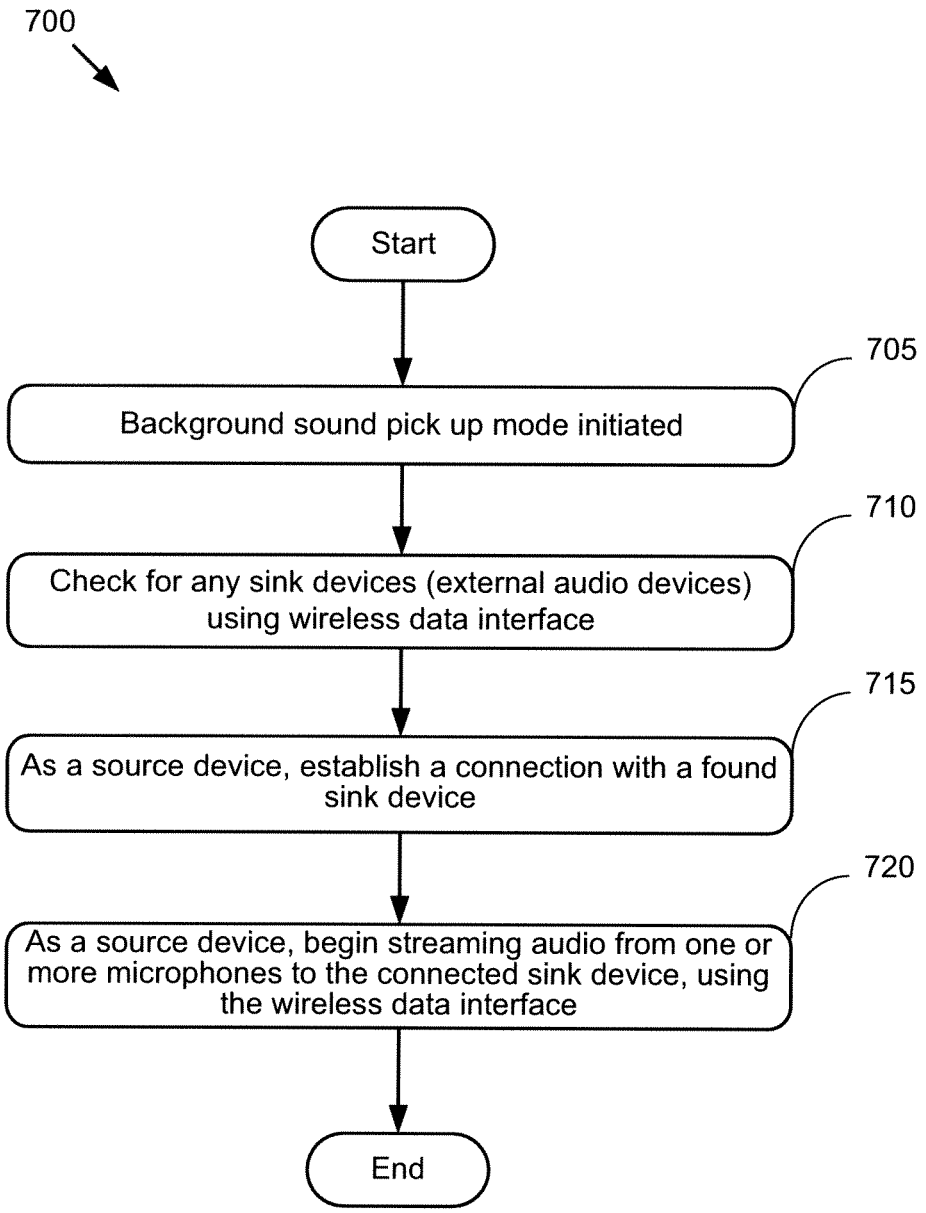
FIG. 7 illustrates a flowchart of one embodiment of operations in the external microphone device.

FIG. 7 illustrates a flowchart of one embodiment of operations in the external microphone device. In one embodiment, the external microphone device that executes process 700 is an external microphone device 150 described in FIG. 1 above. As illustrated in FIG. 7, process 700 begins by initiating (at block 705) the background sound pick up mode at the external microphone device.

At block 710, process 700 checks for any sink devices (external audio devices) using the wireless data interface of the external microphone device. In one embodiment, each of the sink devices detected is a mobile device 100 described in FIG. 1 above. In one embodiment, the wireless data interface of the external microphone device is the wireless data interface 155 described in FIG. 1 above. In one embodiment, the wireless data interface of the external microphone device selects a predefined Bluetooth profile in order to detect the sink devices. In one embodiment, the wireless data interface of the external microphone device uses GAVDP to detect the sink devices.

At block 715, process 700 establishes a connection with a found sink device. In one embodiment, the wireless data interface of the external microphone device selects a predefined Bluetooth profile in order to establish the connection with the sink device. In one embodiment, the wireless data interface of the external microphone device uses GAVDP to establish the connection with the sink device.

At block 720, process 700 begins streaming audio from one or more microphones of the external microphone device (source device) to the connected sink device using the wireless data interface of the external microphone device. In one embodiment, the wireless data interface of the external microphone device uses GAVDP to stream audio to the sink device. In one embodiment, process 700 transfers to the sink device audio data that's either uncompressed or encoded with a lossless codec like FLAC. The resulting audio bitrates (or formats) would not be supported by the Bluetooth standard. However, process 700 could send the audio data to the sink device over Wi-Fi.

In one embodiment, process 700 can send analytics data rather than audio to the sink device. For example, a noise estimate or noise profile (per frequency band or for the entire audio spectrum) could be repeatedly updated and sent (at a certain repetition rate) to update the noise suppressor in the sink device. In one embodiment, instead of streaming the microphone signal, the process 700 computes and sends analytics that are relevant to noise estimation, to the connected sink device, using the wireless data interface of the external microphone device. Examples of the analytics can be, e.g., a raw but bandwidth limited frequency domain conversion of the microphone signal (e.g. previously determined frequency bins only), or a spectral noise profile (frequency domain) that was computed in accordance with any suitable audio noise estimation process. The noise profile may be devoid of distinct speech.

One of ordinary skill in the art will recognize that process 700 is a conceptual representation of the operations executed by the external microphone device. The specific operations of process 700 may not be performed in the exact order shown and described. The specific operations may not be performed in one continuous series of operations, and different specific operations may be performed in different embodiments. Furthermore, process 700 could be implemented using several sub-processes, or as part of a larger macro process.

Figure 8:
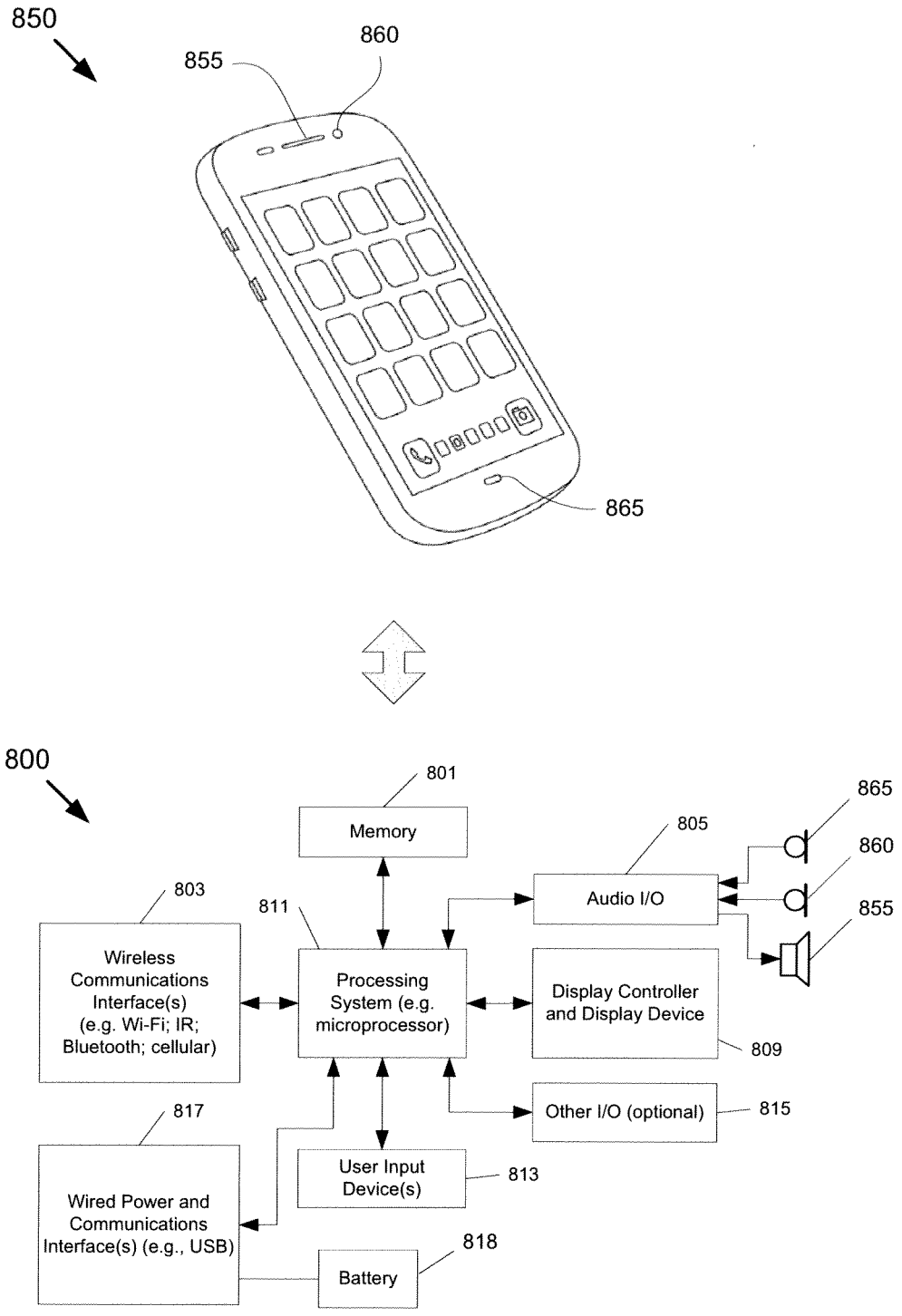
FIG. 8 shows an example of a data processing system that may be used with one embodiment of the invention.

FIG. 8 shows an example of a data processing system 800 that may be used with one embodiment of the invention. Specifically, this figure shows a mobile device 850 and an example of constituent electronic hardware components for it, as data processing system 800. The mobile device 850 shown in FIG. 8 includes a receiver 855 that reproduces the voice of the remote person during a phone call, a primary (internal or built-in) microphone 865 for the user to speak into, and a secondary microphone 860.

The data processing system 800 shown in FIG. 8 includes a processing system 811, which may be one or more microprocessors or a system on a chip integrated circuit. The data processing system 800 also includes memory 801 for storing data and programs for execution by the processing system 811. The data processing system 800 also includes an audio input/output subsystem 805, which may include a primary microphone 865, a secondary microphone 860, and a speaker 855, for example, for playing back music or providing telephone functionality through the speaker and microphones.

A display controller and display device 809 provide a digital visual user interface for the user; this digital interface may include a graphical user interface. The system 800 also includes one or more wireless communications interfaces 803 to communicate with another data processing system, such as the external microphone device 150 (see FIG. 1). A wireless communications interface may be a WLAN transceiver, an infrared transceiver, a Bluetooth transceiver, and/or a cellular telephony transceiver. It will be appreciated that additional components, not shown, may also be part of the system 800 in certain embodiments, and in certain embodiments fewer components than shown in FIG. 8 may also be used in a data processing system. The system 800 further includes one or more wired power and communications interfaces 817 to communicate with another data processing system. The wired power and communications interface may be a USB port, etc. and may connect to a battery 818.

The data processing system 800 also includes one or more user input devices 813, which allow a user to provide input to the system. These input devices may be a keypad or keyboard, or a touch panel or multi touch panel. The data processing system 800 also includes an optional input/output device 815 which may be a connector for a dock. It will be appreciated that one or more buses, not shown, may be used to interconnect the various components as is well known in the art. The data processing system shown in FIG. 8 may be a handheld device or a personal digital assistant (PDA), or a cellular telephone with PDA-like functionality, or a handheld device which includes a cellular telephone, or a media player, or a device which combines aspects or functions of these devices, such as a media player function and a cellular telephone function in a single device housing such as a headset, or an embedded device or other consumer electronic devices. In other embodiments, the data processing system 800 may be a network computer or an embedded processing device within another device or other type of data processing systems, which have fewer components or perhaps more components than that shown in FIG. 8.

The digital signal processing operations described above, such as evaluation of the external microphone signal, non-microphone sensor processing including GPS, and the audio signal processing including for example filtering, noise estimation, and noise suppression, can all be done either entirely by a programmed processor (e.g., as part of the processing system 811, or portions of them can be separated out and be performed by dedicated hardwired logic circuits (not shown).

The foregoing discussion merely describes some exemplary embodiments of the present invention. One skilled in the art will readily recognize from such discussion, from the accompanying drawings, and from the claims that various modifications can be made without departing from the spirit and scope of the invention.

What is claimed is:

1. A method for processing a first signal produced by an internal microphone of a mobile device, the method comprising:

receiving a first signal produced by the internal microphone of the mobile device;

detecting an external microphone device within proximity of the mobile device;

receiving a second signal from the external microphone device wirelessly, the second signal being a noise estimate that is computed from an audio signal produced by a microphone of the external microphone device and that is devoid of speech which was picked up by the microphone of the external microphone device;

generating a noise profile based on the second signal if the second signal contains a better sampling of background/ambient noise when compared to the first signal; and suppressing noise in the first signal in accordance with the noise profile.

2. The method of claim 1 further comprising establishing a wireless connection with the external microphone device, wherein the receiving of the second signal from the external microphone device is through the wireless connection.

3. The method of claim 1 further comprising:

synchronizing the second signal with the first signal.

4. The method of claim 1 further comprising launching one of a phone application or a media recording application, prior to receiving the second signal.

5. The method of claim 1, wherein the external microphone device is a wearable device that is worn on a trunk or limb of a user who is using the mobile device.

6. The method of claim 1, wherein the external microphone device is situated at a stationary or fixed indoor location.

7. The method of claim 1, wherein the external microphone device is situated at a stationary or fixed outdoor location.

8. The method of claim 7, wherein the external microphone device is determined to be within proximity of the mobile device using a Global Positioning System (GPS).

9. The method of claim 1, wherein the external microphone device is a second mobile device being one of a mobile phone and a tablet computer, wherein the second mobile device is determined to be within proximity of the mobile device using a mobile phone position tracking system.

10. A method for providing an ambient sound pickup signal from a microphone device to nearby audio devices, the method comprising:

identifying, at the microphone device, an external audio device that is within proximity of the microphone device; and sending a first signal, the first signal being a noise estimate that is computed from an audio signal produced by a microphone of the microphone device and that is devoid of speech which was picked up by the microphone of the microphone device, to the external audio device to enable the external audio device to compute a noise profile based on the first signal if the first signal contains a better sampling of background/ambient noise when compared to a second signal that is produced by an internal microphone of the external audio device, and suppress noise in the second signal in accordance with the noise profile.

11. The method of claim 10 further comprising establishing a wireless connection with the external audio device, wherein the sending of the first signal to the external audio device is through the wireless connection.

12. The method of claim 10, wherein the microphone device is a wearable device that is worn on a trunk or limb of a user who is using the external audio device.

13. The method of claim 10, wherein the microphone device is situated at a fixed or stationary indoor or outdoor location.

14. The method of claim 10, wherein the external audio device is a first mobile phone, the microphone device is a second mobile phone, and the first mobile phone is determined to be within proximity of the second mobile phone using a mobile phone position tracking system.

15. A mobile device comprising:

an internal microphone to produce a first signal;

a wireless data interface to identify an external microphone device within proximity of the mobile device and receive a second signal from the external microphone device, the second signal being a noise estimate that is computed from an audio signal produced by a microphone of the external microphone device and that is devoid of speech which was picked up by the microphone of the external microphone device; and a processor to generate a noise profile based on the second signal if the second signal contains a better sampling of background/ambient noise when compared to the first signal, and to suppress noise from the first signal using the noise profile.

16. The mobile device of claim 15, wherein the wireless data interface is further configured to establish a wireless connection with the external microphone device, wherein the wireless data interface is configured to receive the second signal from the external microphone device through the wireless connection.

17. The mobile device of claim 15, wherein the external microphone device is a wearable device that is worn on trunk or limb part of a user of the mobile device.

18. The mobile device of claim 15, wherein the external microphone device is situated at a stationary or fixed outdoor location.

19. The mobile device of claim 18, wherein the external microphone device is determined to be within proximity of the mobile device using a Global Positioning System (GPS).

* * * * *